US008507424B2

(12) United States Patent
Ooi et al.

(10) Patent No.: US 8,507,424 B2
(45) Date of Patent: Aug. 13, 2013

(54) PROCESS FOR PRODUCING OLIGOMERS

(75) Inventors: Tian Lye Ooi, Kajang (MY); Salmiah Ahmad, Kajang (MY); Shoot Kian Yeong, Kajang (MY); Chun Ming Teoh, Kajang (MY)

(73) Assignee: Malaysian Palm Oil Board, Selangor (MY)

( * ) Notice: Subject to any disclaimer, the term of this patent is extended or adjusted under 35 U.S.C. 154(b) by 1639 days.

(21) Appl. No.: 11/171,207

(22) Filed: Jul. 1, 2005

(65) Prior Publication Data

US 2006/0003903 A1 Jan. 5, 2006

(30) Foreign Application Priority Data

Jul. 5, 2004 (MY) ..... PI 20042661

(51) Int. Cl.
*C10M 129/70* (2006.01)

(52) U.S. Cl.
USPC ..... 508/506; 508/345; 508/463

(58) Field of Classification Search
USPC ..... 508/345, 506, 463
See application file for complete search history.

(56) References Cited

U.S. PATENT DOCUMENTS

| | | | | |
|---|---|---|---|---|
| 3,609,107 | A * | 9/1971 | Boyer et al. | 521/168 |
| 3,904,385 | A * | 9/1975 | Sweeney | 44/397 |
| 3,951,929 | A | 4/1976 | Sweeney | |
| 3,957,659 | A | 5/1976 | Van De Kraats | |
| 4,110,283 | A | 8/1978 | Capelle | |
| 5,338,471 | A * | 8/1994 | Lal | 508/186 |
| 6,107,433 | A * | 8/2000 | Petrovic et al. | 528/1 |
| 2004/0248744 | A1 * | 12/2004 | King et al. | 508/437 |

FOREIGN PATENT DOCUMENTS

| | | |
|---|---|---|
| DE | 2210431 | 1/1973 |
| DE | 2612757 | 9/1977 |
| GB | 2058825 | 4/1981 |
| GB | 2082604 | 3/1982 |

OTHER PUBLICATIONS

Bockisch, Michael Fats and Oils Handbook . . . AOCS Press, 1998, Chapter 4. Online version available at: http://knovel.com/web/portal/browse/display?_EXT_KNOVEL_DISPLAY_bookid=2296&VerticalID=0.*

* cited by examiner

*Primary Examiner* — Jim Goloboy

(74) *Attorney, Agent, or Firm* — Preston Smirman; Smirman IP Law, PLLC

(57) ABSTRACT

The present invention relates to a process for producing oligomers and a method for improving the low temperature properties of fatty alkyl esters by using these oligomers. The oligomers according to the present invention are used as pour point depressant and cloud point reducer to improve the pour point and cloud point of fatty alkyl esters such as isopropyl, butyl, ethyl, ethylhexyl esters particularly fatty acid methyl esters at low temperature.

12 Claims, No Drawings

PROCESS FOR PRODUCING OLIGOMERS

FIELD OF THE INVENTION

The present invention relates to a process for producing oligomers, more particularly it relates to a process for producing vegetable oil derived oligomers to be used as an additive for improving low temperature properties of fatty alkyl esters.

BACKGROUND OF THE INVENTION

There are plenty uses in fatty alkyl esters of vegetable oil, animal oils and marine oils. They are widely used as industrial fluids, especially as lubricants in the metal working industry, as base oil for drilling muds, industrial solvents, as carriers for the active ingredients in pesticides formulation and as diesel fuels. The advantages of the metyl esters such as low cost, lower toxicity and environmental friendliness have made the methyl esters a more preferable choice to be used in the above freezing point of water has restricted their many uses at low temperatures causing poor pumpability, precipitation and pourability of the esters during cold season. Palm oil alkyl esters have high saturation restricted their usages at low temperatures.

Several pour point depressants or cloud point reducer which available in the market are mineral based. In addition, they are normally suitable for mineral oil based liquid. Several pour point depressants are already known, U.S. Pat. Nos. 3,904,385 and 3,951,929, as well as corresponding German Application No. 22 64 328 describe the use of polymeric acrylates containing from 18 to 24 carbon atoms in the alcohol moiety. The disadvantage of these polymeric acrylates is that they have to be used in relatively high concentrations of from 0.01 to 3% by weight, based on the weight of the petroleum.

Copolymers of long-chain acrylic or methacrylic acid esters and 4-vinyl pyridine are described for the same utility in U.S. Pat. No. 3,957,659, as well as corresponding German Application No. 22 10 431 and in U.S. Pat. No. 4,110,283, as well as corresponding German Application No. 26 12 757. The copolymers in question are used in concentrations of from 200 to 2000 ppm. The disadvantage of these copolymers is that they are comparatively expensive because 4-vinyl pyridine is difficult to obtain on a commercial scale.

British Patent Specification No. 2,058,825, describe copolymers of long-chain acrylic acid esters, namely esters of "Ziegler-process" alcohols, and dimethylaminoalkyl acrylic acid esters or methacrylic acid esters for use as pour point depressants. Particular emphasis is placed on the shear stability of the products and also their effectiveness in concentrations of from 50 to 350 ppm. However, it is known that esters of the type in question (containing dialkylamino groups) can undergo hydrolysis in the presence of water, resulting in the formation of amphoteric, largely insoluble and hence ineffectual polymers. Finally, British Patent Specification No. 2,082,604, describe a copolymer of long-chain acrylates and maleic acid anhydride as a pour point depressant. The disadvantage of using this copolymer is that, because of their high reactivity, the anhydride groups are capable of further reacting to form acids which might possibly promote corrosion.

SUMMARY OF THE INVENTION

It is therefore, natural oil derived compound is synthesized to lower the pour point and cloud point of methyl esters to be used more effectively in cold climate.

The present invention provides oligomers derived from vegetable oils which may be used as pour point depressants and cloud point reducer. They are used as additive to improve the low temperature properties of fatty alkyl esters. The depression of pour point and cloud point of fatty alkyl esters are important to enhance their usage at low temperatures. The addition of small percentage of palm oil derived oligomers achieved a significant lowering of pour point and cloud point of palm oil and palm kernal oil methyl esters. This has enhanced the properties and performance of methyl esters with additive, oligomer, to be used in cold climate. The present invention encompasses fatty alkyl ester composition containing vegetable oil preferably palm oil derived oligomers and also reduced the pour point of methyl esters from about 15 degree celcius to about minus 30 degree celcius, a reduction of about 45 degree celcius and a cloud point from about 9C to about 2C.

The present invention relates to a process for preparing oligomers comprising the steps of: (a) preparing vegetable oil derivative by reacting vegetable oil with a peroxyacid; (b) reacting the product from step (a) with an alcohol to form oligomer; (c) esterification said oligomer of step (b) with an acid to form polyester oligomer.

In addition, this invention also encompasses processes for making fatty alkyl esters composition having depressed pour points and cloud point according to the present invention and method of using said composition.

It is an object of the present invention to provide an oligomer to be used as pour point depressant or cloud point reducer.

Another object of the present invention is to provide a vegetable oil based pour point depressant or cloud point reducer.

Still another object of the present invention is to produce an oligomer for lowering the pour point of alkyl esters from about 15 degree celcius to about minus 30 degree celcius.

A further object of the present invention is to produce an oligomer for lowering the cloud point of alkyl esters from about 9C to about 2C.

An object of the present invention is to prepare an oligomer which may be used as a pour point depressant or cloud point reducer even in cold climate environment.

DETAILED DESCRIPTION OF THE INVENTION

The present invention relates to a process for preparing oligomers comprising the steps of: (a) preparing vegetable oil derivative by reacting vegetable oil with a peroxyacid; (b) reacting the product from step (a) with an alcohol to form oligomer; (c) esterification said oligomer of step (b) with an acid to form polyester oligomer.

In the preferred embodiment of the present invention, said vegetable oil is palm oil comprising any one or combination of palm oil, palm sterin, palm olein, palm kernal oil, palm kernal stearin, palm kernal olein, or all of which could be refined or crude.

The alcohol of step (b) is a monohydric or polyhydric alcohol including ethylene, glycol, propylene glycol, glycerol, diethylene glycol, diproylene glycol, dipropylene glycol, trimethylopropene and pentaerythritol.

The peroxyacid of step (a) is peroxyacetic acid and butyl methacerylic acid.

In another embodiment of the present invention, the process may further comprising the step of adding catalyst to accelerate the process of oligomer forming.

The process may be used to produce oligomers with different combination of alcohol and acid.

Further, the present invention relates to a composition for lowering the pour point and cloud point of fatty alkyl esters comprising of (a) about 95% to about 99% by weight of hydrocarbon fluid preferably fatty alkyl esters; and (b) about 1% to about 5% by weight of any one or combination of oligomer A, oligomer B, oligomer C and oligomer D according to the aforementioned process. Oligomer A, oligomer B, oligomer C and oligomer D is produced with the same process but different on the type of alcohol and the acid used for esterification. In another embodiment of the present invention, the composition may further comprising about 0.5 to 1% by weight of co-additive preferably pour point depressant and cloud point reducer.

Further, the present invention relates to a method for lowering the pour point and cloud point of fatty alkyl esters by mixing of afore-mentioned composition at a temperature in the range of about 25° C. to about 90° C.

The fatty alkyl esters in the present invention are derived from vegetable oil, mineral oil or marine oil which containing 8 to 20 carbon atoms.

The following examples are intended to further illustrate the invention, without any intent for the invention to be limited to the specific embodiments described therein

EXAMPLE 1

Preparation of Palm Oil Derived Oligomers

Polyhydric alcohol, PH (1 mole equivalent, gm) and phenothiazine (1 ppm) were placed in a liter multineck reactor with an attached mechanical stirrer. The reactor was heated in an oil bath. 1% (mole equivalent weight) of catalyst BF3 was added dropwise to reaction mixture. At the same time, this resulted the temperature increased. Peroxyacid reacted palm oil (equivalent weight, gm) was slowly added in reaction mixture into the reactor once the temperature reached about 80° C. The completion of reaction time took 4 hours. The reaction mixture was allowed to cool, thin and purified.

Purification method was performed by reaction mixture was washed with hot water to remove unreacted polyhydric alcohol, phenothiazine and the catalyst. The obtained oligomer was viscous liquid.

The oligomers were produced in pilot plant scale. Peroxyacid reacted palm oil was prepared by reacting appropriate amount of refined bleached palm oil or palm olein with tn-situ prepared peracetic acid or performic acid at about 45-60° C.

The oligomers were then produced by reacting the peroxyacid reacted palm oil and the pre-mixed polyhydric alcohols and BF3 at about 60-90° C. after which esterified with methacrylic acid. The products were then labeled as oligomer A, oligomer B, oligomer C and oligomer D, depending on the type of alcohol and the acid used for esterification.

Typical properties of these oligomers are: light yellow liquid to paste appearance (at 25° C.), specific gravity ranging from 0.93-0.96, acid value ranging from 0.5 to 8.0 and hydroxyl value (mgKOH/g) ranging from 5 to 280.7

EXAMPLE 2

Preparation of Fatty Alkyl Esters

In the present invention, the palm oil methyl ester consists of methyl esters of chain length of fatty acyl groups are in the range of about 14 to about 20 carbon atoms, preferably containing 16 to 18 carbon atoms. Typical composition of these esters are shown in Table 1.

TABLE 1

Typical fatty acid composition of palm oil and palm kernel oil methyl esters

| Fatty acid composition | Palm oil | Palm kernel oil |
|---|---|---|
| C8 | — | 0.04 |
| C10 | — | 0.2 |
| C12 | 0.3 | 48.6 |
| C14 | 1.0 | 18.1 |
| C16 | 39.8 | 10.6 |
| C18:0 | 4.2 | 2.6 |
| C18:1 | 43.8 | 17.5 |
| C18:2 | 10.4 | 2.1 |
| C18:3 | — | 0.1 |

EXAMPLE 3

Production of Mixtures of Fatty Acid Methyl Esters Having Improved Low-Temperature Properties About 95 to 99% by weight of any one or combination of palm oil methyl esters and palm kernel methyl esters as described in example 2 is mixed with about 1 to 5% by weight of at least one of the oligomers and co-additive described below The components may be mixed purely mechanically. For example, no chemical reaction takes place in stirring. Mixtures having particularly good low temperature properties.

Pour point tests were done according to ASTM method D97 showed that addition of oligomers is effective in depressing the pour points of fatty alkylesters. For example, addition of 2% of one of the oligomers significantly reduced the pour point of palm oil methyl from 15C to about −24C.

The pour point of the methyl esters can be further depressed by increasing the dosage of one of the oligomers and a coadditive selected from sorbitan esters. With these, the pour point of methyl esters could be successfully reduced by about 45° C., from 15C to about minus 30° C. and cloud point from 9C to 2C.

It is to be understood that the present invention may be embodied in other specific forms and is not limited to the sole embodiment described above. However modification and equivalents of the disclosed concepts such as those which readily occur to one skilled in the art are intended to be included within the scope of the claims which are appended thereto.

The invention claimed is:

1. A process for preparing oligomers comprising the steps of:

(a) preparing palm oil derivative by reacting palm kernel oil with a peroxyacid;

(b) reacting the product from step (a) with a polyhydric alcohol to form oligomer; and (c) esterifying said oligomer of step (b) with an acid selected from the group consisting of acrylic acid, methacrylic acid, methyl methacrylic acid, ethyl methacrylic acid, propyl methacrylic acid and butyl methacrylic acid to form polyester oligomer.

2. The process according to claim 1, wherein said peroxyacid of step (a) is peroxyacetic acid, performic acid or combinations thereof.

3. The process according to claim 2, wherein said alcohol is at least one alcohol selected from the group consisting of ethylene glycol, propylene glycol, glycerol, diethylene glycol, dipropylene glycol, trimethylolpropane and pentaerythritol.

4. The process according to claim 1, wherein said process further comprises the step of adding catalyst into the vegetable oil derivative during the reaction between the vegetable oil derivative and the alcohol.

5. A composition for lowering the pour point and cloud point of a fatty alkyl ester comprising of:

(a) a fatty alkyl ester;

(b) at least one polyester oligomer obtained from an esterification between an oligomer and an acid selected from the group consisting of acrylic acid, methacrylic acid, methyl methacrylic acid, ethyl methacrylic acid, propyl methacrylic acid and butyl methacrylic acid; wherein the oligomer is formed by a reaction among a palm oil derivative, a peroxyacid and a polyhydric alcohol, and (c) a sorbitan ester.

6. The composition according to claim 5, wherein said fatty acid alkyl esters contains about 8 to 18 carbon atoms.

7. The composition according to claim 5, wherein said fatty alkyl esters are present in a concentration of about 96% to about 99% by weight of the composition.

8. The composition according to claim 5, wherein said fatty alkyl esters are alkyl esters derived from vegetable oil, animal oil or marine oil.

9. The composition according to claim 5, wherein said alcohol is at least one alcohol selected from the group consisting of ethylene glycol, propylene glycol, glycerol, diethylene glycol, dipropylene glycol, trimethylolpropane and pentaerythritol.

10. The composition according to claim 5, wherein said oligomer are present in a concentration of about 1% to about 5% by weight of the composition.

11. The composition according to claim 5, wherein said sorbitan ester is present in an amount of about 0.55% to 1% by weight of by weight of the composition.

12. A method for lowering pour point and cloud point of hydrocarbon fluid comprising adding into the hydrocarbon fluid 1% to 4% of a polyester oligomer by weight at a temperature ranging from 25° C. to 90° C.: wherein the polyester oligomer is obtained from an esterification between an oligomer and an acid selected from the group consisting of acrylic acid, methacrylic acid, methyl methacrylic acid, ethyl methacrylic acid, propyl methacrylic acid and butyl methacrylic acid: and the oligomer is formed by a reaction among a palm oil derivative, a peroxyacid and a polyhydric alcohol.

* * * * *